US008006892B2

(12) United States Patent
Polvi et al.

(10) Patent No.: US 8,006,892 B2
(45) Date of Patent: Aug. 30, 2011

(54) METHOD FOR FORMING A TIGHT-FITTING SILVER SURFACE ON AN ALUMINIUM PIECE

(75) Inventors: Veikko Polvi, Noormarkku (FI); Karri Osara, Noormarkku (FI)

(73) Assignee: Outotec Oyj, Espoo (FI)

( * ) Notice: Subject to any disclaimer, the term of this patent is extended or adjusted under 35 U.S.C. 154(b) by 329 days.

(21) Appl. No.: 11/912,532

(22) PCT Filed: Apr. 25, 2006

(86) PCT No.: PCT/FI2006/000132

§ 371 (c)(1),
(2), (4) Date: Oct. 25, 2007

(87) PCT Pub. No.: WO2006/117425

PCT Pub. Date: Nov. 9, 2006

(65) Prior Publication Data

US 2008/0190994 A1 Aug. 14, 2008

(30) Foreign Application Priority Data

Apr. 29, 2005 (FI) ..... 20050449

(51) Int. Cl.
*B23K 20/00* (2006.01)

(52) U.S. Cl. ..... 228/228; 228/193; 228/176

(58) Field of Classification Search ..... 228/176, 228/193, 262.5, 262.51, 199, 218–220, 227, 228/228, 262.6, 262.61, 194, 245–262
See application file for complete search history.

(56) References Cited

U.S. PATENT DOCUMENTS

| | | | | | |
|---|---|---|---|---|---|
| 3,063,145 | A | * | 11/1962 | Bouton | 228/262.51 |
| 3,180,022 | A | * | 4/1965 | Briggs et al. | 228/262.51 |
| 3,551,998 | A | * | 1/1971 | Bennett | 228/194 |
| 3,667,110 | A | * | 6/1972 | Gwyn, Jr. | 228/193 |
| 3,858,808 | A | * | 1/1975 | Dillon | 239/429 |
| 5,249,731 | A | * | 10/1993 | Ziemek | 228/148 |
| 6,073,345 | A | * | 6/2000 | Mori et al. | 29/888.43 |
| 2003/0022597 | A1 | * | 1/2003 | Ghoshouni et al. | 451/28 |

FOREIGN PATENT DOCUMENTS

| | | |
|---|---|---|
| EP | 0028763 | 5/1981 |
| EP | 0091222 | 10/1983 |
| EP | 1514634 | 3/2005 |
| GB | 1604976 | 12/1981 |
| WO | 2004042121 | 5/2004 |

* cited by examiner

*Primary Examiner* — Kevin P Kerns
*Assistant Examiner* — Kevin E Yoon
(74) *Attorney, Agent, or Firm* — Chernoff, Vilhauer, McClung & Stenzel

(57) ABSTRACT

The invention relates to a method for forming a highly electroconductive surface on an aluminum piece. A highly conductive layer of silver is formed on the piece by means of a eutectic join. The temperature of the aluminum piece is raised gradually and the oxide layer formed on the surface of the piece is removed. After the first heating stage, the silver piece that is to be attached is transferred to the cleaned surface. The contact point is heated to a temperature where a eutectic bond is generated between the aluminum and silver. During the second heating stage a slight momentary loading is applied to the contact point.

16 Claims, No Drawings

METHOD FOR FORMING A TIGHT-FITTING SILVER SURFACE ON AN ALUMINIUM PIECE

This is a national stage application filed under 35 USC 371 based on International Application No. PCT/FI2006/000132 filed Apr. 25, 2006, and claims priority under 35 USC 119 of Finnish Patent Application No. 20050449 filed Apr. 29, 2005.

FIELD OF THE INVENTION

The invention relates to a method for forming a highly electroconductive surface on an aluminium piece. A highly electroconductive layer of silver is formed on the piece by means of a eutectic join. The temperature of the aluminium piece is raised gradually and the oxide layer formed on the surface of the piece is removed. After the first heating stage, the silver piece that is to be attached is transferred to the cleaned surface and, by simultaneously applying loading to the contact point, it is heated to a temperature where an alloy consistent with the eutectic point is generated between the aluminium and silver, which goes on to form a metallurgical join as it solidifies.

BACKGROUND OF THE INVENTION

Aluminium is a metal used a lot in electricity-conducting structures, because its conductivity is so good. However, aluminium forms an oxide layer on its surface in an air atmosphere, which considerably hampers the conductivity of electricity to or from the aluminium piece. From time to time it is necessary to improve the electrical conductivity of the aluminium piece locally, and this is performed for instance by joining copper pieces to the aluminium piece. Likewise methods are also known where an aluminium and silver join has been made, although not always for reasons of improving conductivity.

When some other material is joined to aluminium, the greatest problem is generally the immediate oxidation of the aluminium in the air atmosphere. The aluminium oxide that is generated is difficult to remove permanently in connection with normal soldering methods. For example commercial cadmium- and fluoride-containing fluxing agents do not remove oxides in sufficient quantities and the join formed by soldering remains porous and weak.

A method is known from WO application 2004/042121, in which a silver coating layer is formed on an aluminium electrode support bar. The contact between the aluminium and the coating material is achieved in particular with a thermal spray coating method. The thermal spraying technique breaks the passivation layer of the aluminium i.e. the oxide layer, so that the contact of the metals is good enough for a metallurgical join to form and for the coating to attach to its substrate.

A hermetic coating on the surface of the aluminium can be achieved with thermal spraying methods, but the equipment required by the methods is rather expensive as yet. In addition, typically in thermal spraying methods, not all of the coating material ends up on the surface of the piece to be coated, and instead, some of the coating material is wasted with regard to the efficiency of the method.

EP patent publication 28763 describes a method for joining metal pieces to each other. The pieces may be the same metal or different metals. The metal joins described in the patent are Al—Al, Cu—Cu and Al—Cu, and also described are joins in which an intermediate agent is introduced between the pieces to be joined, such as an insert of silicon, aluminium-silicon alloy or silver. Bonding takes place by means of pressure at raised oxygen pressure, exploiting the eutectic reaction occurring between the metals. The temperature required by the eutectic reaction depends on the materials to be bonded and the temperature used is in the region of the eutectic temperature—+50° C. The description of the method reveals that when an oxygen-enriched atmosphere is used for heating the pieces, the oxide layers formed on the contact points of the pieces are squeezed out with the liquefied eutectic alloy. Pure oxygen is used in the examples and the pressure used was in the region of 150-710 bar.

The bonding of the pieces to each other described in the EP publication takes place at very high pressure, which squeezes the impurities and the layer that was oxidized during heating out of the joining point. However, the use of an oxygen atmosphere in heating and the high pressure make this a very expensive bonding method.

JP application 57195592 relates to a method to join silver and aluminium to each other, in which the oxidation of the surfaces is prevented by making a join by hot pressing and in a vacuum or inert atmosphere.

The metal join described in the JP application by means of hot pressing and in a vacuum or inert atmosphere is not a particularly cost-effective join solution.

PURPOSE OF THE INVENTION

The purpose of the invention is to eliminate the drawbacks that arise in the methods described above.

The purpose of the invention is to put forward a simple and cheap method for forming a highly conductive silver coating on a piece of aluminium. The aim is to put forward a method in which the silver coating is formed on the surface of the aluminium piece in a normal or slightly reductive environment and where the loading used in the join is only a fraction of that used in the prior art.

The purpose of the invention is to put forward a method in which the aluminium piece is heated in stages, so that the silver piece is placed on the surface of the aluminium between heating periods. Before the silver piece is applied, the oxide layer may also be removed from the surface of the aluminium piece.

SUMMARY OF THE INVENTION

The essential features of the method according to the invention are presented in the attached claims.

The invention relates to a method for forming a highly electroconductive silver coating on the surface of an aluminium piece, whereby the aluminium piece, cleaned of the oxide layer, is heated in stages. After the first heating stage the silver piece is applied to the surface of the aluminium. The second heating stage is carried out at least at the temperature required by the eutectic reaction between aluminium and silver, where a metallurgical join is formed from the diffusion and molten layer between the metals. Heating takes place in atmospheric or slightly reductive conditions. Loading of around 0.2-3 bar is applied to the joining point. Preferably the loading is spot-like and repeated cyclically. The oxide layer is removed from the join surface of the aluminium piece as necessary after the first heating stage before the silver piece is applied to the join surface.

DETAILED DESCRIPTION OF THE INVENTION

On the basis of the equilibrium drawing of silver and aluminium it is known that the minimum eutectic melting point is at 567° C. The solubility of silver into aluminium rises steeply from 400° C. up to the eutectic temperature, where the maximum solubility is around 56 per cent by weight. The solubility of aluminium into silver at the eutectic point is around 5 per cent by weight. When the temperature is raised as the pieces are joined, a thin oxide film is created on the surface of the silver, which, however, breaks down at a temperature of about 200° C. This enables effective diffusion and generation reactions of a metallurgical join.

In the method now developed, the aim was to form a metallurgical join between aluminium and silver as easily and straightforwardly as possible. According to the method, the join area of an aluminium piece is cleaned of its oxide layer and heated to 270-330° C., preferably to 300° C. The removal of the oxide layer may be performed mechanically for instance by grinding, since the join area in question is generally not extensive. If necessary the removal of the oxide layer is also carried out after the first heating stage. However, with the correct allocation, linear work stages and correctly timed working, the removal of an oxide layer at high temperatures can easily be avoided, and treatment can be done in its entirety before commencing heating. However, to ensure unconditionally good quality, grinding can be carried out between heating stages too.

Immediately after the first heating stage and possible oxide layer removal, the silver piece or silver foil to be attached is applied to the surface of the aluminium piece and the heating of the pieces is continued in the second stage towards the eutectic point of Al—Ag. During heating the silver piece is pressed lightly so that the loading is around 0.2-3 bar. The pressure does not necessarily have to be continuous and over the entire area of the silver piece, instead it is preferably spot-like and repeated cyclically. When the join area reaches the eutectic point, eutectics begin to bubble out under the silver piece. Heating is continued until there is a eutectic melt in the entire join area. When heating of the piece is stopped, the eutectic alloy that is formed solidifies and the silver is fastened to the aluminium by a metallurgical bond.

Heating of the aluminium piece takes place depending on the piece either using a preheating torch, a heat-controlled heating tool adapted for the object (e.g. resistance-operated) or in a furnace. Heating may be done in either a normal air atmosphere or in slightly reductive conditions. Reductive conditions are achieved when for instance the preheating torch is adjusted to work with a reductive flame. If heating is performed in a furnace, either an inert shielding gas (e.g. argon) or a reductive gas (e.g. hydrogen) can be fed into the furnace.

The efficiency of the method now developed in the coating work itself is 100%, although any finishing machining may reduce the efficiency to some degree. On the other hand, finishing machining reduces the efficiency of a coating material made with hot spraying for instance in exactly the same way. When coating with silver in particular high efficiency means considerable savings in material costs.

EXAMPLES

Example 1

A silver join was made on aluminium test rods with the method according to the invention. Heating was carried out with an acetylene torch and the temperature of the pieces was monitored during heating with a thermocouple-based digital surface thermometer. When the surface temperature of the test rod reached 300° C., the oxide layer was removed from the surface by grinding and the silver piece was placed on the cleaned surface. Heating was resumed up to the eutectic temperature of 567° C. Spot-like and intermittent loading of the order of 0.3-0.6 bar was directed on some test rods during heating, and others were not subjected to any loading at all. In practice heating could be continued to 25° C., even 40° C. above the eutectic point. Diffusion reactions proceed so quickly at said temperatures in the metals in question, that the formation of the join takes only a few seconds. In practical routine work, controlling the temperature can be done visually by monitoring the behaviour of the melt/the melt bubbling out of the join edge. A reductive flame is achieved by ordinary torch adjustment (reductive part in the flame).

Microsections were taken from the cooled test rods, and were examined by microscope. The microscope pictures showed that the eutectic in the test rods fabricated without loading had spread with a fragmentary and undulating topography, in fairly thick zones towards both the aluminium and the silver. The pictures also show a sigma phase, which is generated in the high temperatures of the eutectic point. The thickness of the join edge was several hundreds of micrometers.

The microscope pictures of the test rods where loading had been used during joining showed that during mechanical compression the eutectic melt had bubbled out of the join edge and as a result there was an even join edge that was only tens of micrometers in thickness.

Tensile strength tests were carried out on the test rods that had been subjected to loading during heating, in order to ascertain the strength of the joins. The average ultimate tensile strength of the rods was over 94 $N/mm^2$.

The invention claimed is:

1. A method for forming a highly electroconductive silver coating on the surface of an aluminum piece, there being an oxide layer on the surface of the aluminum piece, and the method comprising:

removing the oxide layer from the surface of the aluminum piece, heating the aluminum piece in a first stage, cleaning the surface of the aluminum piece after the first heating stage in order to remove any oxide layer formed on said surface after removing the oxide layer before the first heating stage, after the first heating stage, placing a silver piece in contact with a surface of the aluminum piece, heating the aluminum piece and the silver piece in contact therewith in a second stage at least to the temperature required for the eutectic reaction between aluminum and silver, the heating taking place under slightly reductive conditions, and during the second heating stage, pressing the silver piece against the aluminum piece by cyclically applying a load in the order of 0.2-3 bar to an area of the silver piece that is smaller than the silver piece.

2. A method according to claim 1, wherein in the first heating stage the temperature of the aluminum piece is raised to a range between 280-330° C.

3. A method according to claim 2, wherein in the first heating stage the temperature of the aluminum piece is raised to a temperature of around 300° C.

4. A method according to claim 1, comprising removing an oxide layer formed on the surface of the aluminum after the first heating stage.

5. A method according to claim 4, comprising removing the oxide layer mechanically by grinding.

6. A method according to claim 1, comprising heating the aluminum piece and the silver piece with a preheating torch.

7. A method according to claim 6, comprising heating the aluminum piece and the silver piece with an acetylene torch.

8. A method according to claim 6, comprising carrying out the heating in the reductive part of the flame of the torch.

9. A method according to claim 1, comprising heating the aluminum piece and the silver piece with a temperature-controlled heating tool.

10. A method according to claim 1, comprising heating the aluminum piece and the silver piece in a furnace.

11. A method according to claim 10, comprising providing a shielding gas atmosphere in the furnace.

12. A method according to claim 10, comprising providing a reductive atmosphere in the furnace.

13. A method according to claim 1, wherein the silver piece is a silver foil.

14. A method according to claim 13, comprising pressing the silver piece against the aluminum piece by intermittently applying a load having a magnitude of 0.3-0.6 bar.

15. A method for forming a highly electroconductive silver coating on the surface of an aluminum piece, there being an oxide layer on the surface of the aluminum piece, and the method comprising:

providing a silver piece distinct from the aluminum piece, removing the oxide layer from the surface of the aluminum piece, heating the aluminum piece in a first stage after removing the oxide layer, after the first heating stage, placing the silver piece in contact with a surface of the aluminum piece, heating the aluminum piece and the silver piece in contact therewith in a second stage at least to the temperature required for the eutectic reaction between aluminum and silver, and during the second heating stage, pressing the silver piece against the aluminum piece by cyclically applying a load in the order of 0.2-3 bar to an area of the silver piece that is smaller than the silver piece.

16. A method according to claim 15, comprising cleaning the surface of the aluminum piece after the first heating stage in order to remove any oxide layer formed on said surface after removing the oxide layer before the first heating stage.

* * * * *